US010131976B2

(12) United States Patent
Dorner et al.

(10) Patent No.: US 10,131,976 B2
(45) Date of Patent: Nov. 20, 2018

(54) COLD-ROLLED FLAT STEEL PRODUCT FOR DEEP DRAWING APPLICATIONS AND METHOD FOR PRODUCTION THEREOF

(71) Applicant: ThyssenKrupp Steel Europe AG, Duisburg (DE)

(72) Inventors: Dorothée Dorner, Dusseldorf (DE); Christian Höckling, Duisburg (DE); Harald Hofmann, Dortmund (DE); Magnus Miller, Duisburg (DE); Matthias Schirmer, Dusseldorf (DE); Jonas Schwabe, Duisburg (DE); Alexander Zimmermann, Aachen (DE)

(73) Assignee: Thyssenkrupp Steel Europe AG, Duisburg (DE)

( * ) Notice: Subject to any disclaimer, the term of this patent is extended or adjusted under 35 U.S.C. 154(b) by 166 days.

(21) Appl. No.: 14/767,770

(22) PCT Filed: Feb. 13, 2014

(86) PCT No.: PCT/EP2014/052811

§ 371 (c)(1),
(2) Date: Aug. 13, 2015

(87) PCT Pub. No.: WO2014/125017

PCT Pub. Date: Aug. 21, 2014

(65) Prior Publication Data

US 2015/0376751 A1 Dec. 31, 2015

(30) Foreign Application Priority Data

Feb. 14, 2013 (EP) ..... 13155226

(51) Int. Cl.

| | |
|---|---|
| ***C22C 38/50*** | (2006.01) |
| ***C22C 38/02*** | (2006.01) |
| ***C22C 38/06*** | (2006.01) |
| ***C21D 8/04*** | (2006.01) |
| ***C21D 9/48*** | (2006.01) |
| ***C22C 38/00*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C22C 38/50* (2013.01); *C21D 8/0405* (2013.01); *C21D 8/0426* (2013.01); *C21D 8/0436* (2013.01); *C21D 8/0463* (2013.01); *C21D 9/48* (2013.01); *C22C 38/001* (2013.01); *C22C 38/004* (2013.01); *C22C 38/005* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01)

(58) Field of Classification Search

CPC ..... C22C 38/02; C22C 38/06; C22C 38/50
USPC ..... 148/331; 420/77
See application file for complete search history.

(56) References Cited

U.S. PATENT DOCUMENTS

| | | | |
|---|---|---|---|
| 4,334,923 | A | 6/1982 | Sherman |
| 6,383,662 | B1 | 5/2002 | Frommeyer |
| 2010/0300585 | A1 | 12/2010 | Perlade et al. |

FOREIGN PATENT DOCUMENTS

| | | | |
|---|---|---|---|
| EP | 0826787 | A2 | 3/1998 |
| GB | 1044801 | | 10/1966 |
| JP | 2001164336 | A | 6/2001 |
| JP | 2001271136 | A | 10/2001 |
| JP | 2001271148 | A | 10/2001 |
| JP | 2006118000 | A | 5/2006 |
| JP | 2007321168 | A | 12/2007 |
| JP | 2009120962 | A | 6/2009 |
| JP | 2010121213 | A | 6/2010 |

OTHER PUBLICATIONS

Brux et al., Tiefziehfahige Eisen-Aluminium-Leichtbaustahle [Iron-Aluminum-Light-Weight-Steels for deep drawing applications], Konstruktion, Apr. 4, 2002, pp. 81-83.

Xue, Facing 2020—The perspective of chemical industry, metallurgy and materials, The Proceedings of the 6th Academic Conference of the Department of Chemical Metallurgy and Materials Engineering, Chinese Academy of Engineering, pp. 440-442. Relevance: Fig. 3.

*Primary Examiner* — Brian D Walck
(74) *Attorney, Agent, or Firm* — The Webb Law Firm

(57) ABSTRACT

A cold-rolled flat steel product for deep drawing applications is disclosed, composed of a steel which, in addition to Fe and unavoidable impurities (in % by weight) contains C: <0.1%, Al: 6.5-11%, REM: 0.02-0.2%, P: <0.1%, S: <0.03%, N: <0.1% and optionally one or more elements from the group of "Mn, Si, Nb, Ti, Mo, Cr, Zr, V, W, Co, Ni, B, Cu, Ca, N", provided that Mn: <6%, Si: <1%, Nb: <0.3%, Ti: <0.3%, Zr: <1%, V: <1%, V: <1%, Mo: <1%, Cr: <3%, Co: <1%, Ni: <2%, B: <0.1%, Cu: <3%, Ca: <0.015%. For production of such a flat steel product, a steel of appropriate composition is cast to give a pre-product, which is then hot-rolled to hot strip at a hot rolling end temperature of 820-1000° C. The latter is subsequently wound at a winding temperature of up to 850° C., after winding annealed at an annealing temperature of >650-1200° C. for 1-50 h, then cold-rolled in one or more stages with a total cold rolling level of ≥30% to give the cold-rolled flat steel product and finally annealed at 650-850° C.

6 Claims, No Drawings

COLD-ROLLED FLAT STEEL PRODUCT FOR DEEP DRAWING APPLICATIONS AND METHOD FOR PRODUCTION THEREOF

CROSS-REFERENCE TO RELATED APPLICATIONS

This application is the United States national phase of International Application No. PCT/EP2014/052811 filed Feb. 13, 2014, and claims priority to European Patent Application No. 13155226.7 filed Feb. 14, 2013, the disclosures of which are hereby incorporated in their entirety by reference.

BACKGROUND OF THE INVENTION

Field of the Invention

The invention relates to a cold-rolled flat steel product for deep drawing applications, having a reduced weight as a result of a reduction in density combined with optimized mechanical properties and optimized formability. The invention likewise relates to a method for producing such a flat steel product.

Description of Related Art

Where flat steel products are mentioned here, this means steel strips obtained by rolling operations, steel sheets, and blanks, precut pieces and the like that have been obtained therefrom.

If figures relating to the content of an alloy element are given here in connection with an alloying method, these relate to the weight, unless explicitly stated otherwise.

Especially in the case of flat steel products used in the field of motor vehicle construction, not only the ratio of strength to formability but also physical properties such as stiffness and density are of particular significance with regard to the general aim of weight saving and improvement in the intrinsic frequencies of the respective motor vehicle. Distinct minimization of the density, accompanied by minimization of weight, can be achieved in the case of steels by addition of greater contents of lightweight Al to the alloy. In the case of sufficiently high Al contents, in addition, the initial order phase (K state) or Fe3Al (D03) order phase occurs, and these have particle-hardening, strength-enhancing and ductility-reducing effects.

The application-related advantages of ferritic Fe—Al steel having high Al contents of the kind in question here are opposed by the difficulties in production and processing. Thus, practical experience shows that any non-recrystallized strip core region in the hot strip produced from steels of this kind has to be reduced, since difficulties can otherwise occur in the trimming and in the cold rolling of the hot strip. Furthermore, complex operations are necessary in the prior art in order to avoid anisotropic cold strip properties because of an unsuitable cold strip texture. Anisotropism of this kind is characterized by low r and n values, and entails a low elongation at break. This results in problematic forming and processing characteristics of cold-rolled flat steel products produced from Fe—Al steel having a high Al content.

The problems summarized above increase with rising Al content and therefore limit the reduction in density achievable to date. It is thus considered in industry that Al-containing deep-drawable steels may contain a maximum of 6.5% by weight of Al (see U. Brüx "Tiefziehfähige Eisen-Aluminium-Leichtbäustdhle" [Deep-drawable lightweight iron-aluminum steels], Konstruktion Apr. 4, 2002).

SUMMARY OF THE INVENTION

Against the background of the prior art elucidated above, it was an object of the present invention to provide a flat steel product which, coupled with a distinct reduction in weight, has optimized suitability for deformation and likewise optimized mechanical properties.

In addition, a method for producing such a flat steel product was to be specified.

A cold-rolled flat steel product of the invention for deep drawing applications consists of a steel which, in addition to iron and unavoidable impurities (in % by weight) contains C: up to 0.1%, Al: 6.5-11%, rare earth metals: 0.02-0.2%, P: up to 0.1%, S: up to 0.03%, N: up to 0.1% and optionally one or more elements from the group of "Mn, Si, Nb, Ti, Mo, Cr, Zr, V, W, Co, Ni, B, Cu, Ca, N", provided that Mn: up to 6%, Si: up to 1%, Nb: up to 0.3%, Ti: up to 0.3%, Zr: up to 1%, V: up to 1%, W: up to 1%, Mo: up to 1%, Cr: up to 3%, Co: up to 1%, Ni: up to 2%, B: up to 0.1%, Cu: up to 3%, Ca: up to 0.015%. At the same time, the cold-rolled flat steel product of the invention has an r value of at least 1, and a microstructure very substantially free of κ-carbides. Accordingly, the κ-carbide content of a flat steel product of the invention is 0% by volume (completely κ-carbide-free state) to at most 0.1% by volume. The minimized κ-carbide content assures reliable processibility of the flat steel product of the invention.

In the alloying method envisaged in accordance with the invention for a flat steel product of the invention, apart from iron, only Al and at least one element assigned to the group of the rare earth metals are obligatory constituents. Accordingly, the steel processed in accordance with the invention, in addition to iron and unavoidable impurities (in % by weight), contains at least 6.5-11% Al, up 0.1% C and a content of 0.02-0.2% of one or more elements from the group of the rare earth metals.

DESCRIPTION OF THE INVENTION

The cold-rolled steel strip of the invention features r values of at least 1, and flat steel products of the invention regularly achieve r values greater than 1. The high r value represents good deep-drawability of the cold-rolled flat steel product of the invention, since the tendency to thin out in the course of deep drawing is reduced with rising r value, accompanied by enablement of greater degrees of deep drawing. There would otherwise be the risk of component failure at the site of thinning.

A cold-rolled flat steel product of the invention does not just have high r values but also achieves an elongation D50 of regularly more than 15%, especially at least 18%. It is a characteristic feature of the microstructure of a flat steel product of the invention that that it is completely ferritic and, as stated above, typically very substantially free of κ-carbides (Fe—Al—C carbides).

The high aluminum content of flat steel products of the invention, as well as a decrease in density and weight, also brings about an increase in the energy absorption capacity, accompanied by an improvement in crash behavior. The invention thus provides density-reduced flat steel products having improved crash properties and a comparatively high modulus of elasticity, which can be produced in a simple manner and offers optimal prerequisites for use in motor vehicle construction.

As well as the obligatory constituents, the steel of the invention may contain a multitude of further alloying elements in order to establish particular properties. Useful elements for this purpose are summarized in the group of "Mn, Si, Nb, Ti, Mo, Cr, Zr, V, W, Co, Ni, B, Cu, Ca, N". Each of these optionally added alloying elements may be present or entirely absent in the steel of the invention and the particular element should also be regarded as "absent" when it is present in the flat steel product of the invention in an amount in which it is ineffective and can therefore be counted among the impurities that are an unavoidable result of the production.

Aluminum is present in the steel of the invention in contents of 6.5%-11% by weight, advantageous Al contents being more than 6.5% by weight, especially more than 6.7% by weight or more than 7% by weight, with regard to the desired reduction in density. The presence of high Al contents reduces the density of the steel and distinctly improves the corrosion resistance and oxidation resistance thereof. At the same time, Al in these contents increases the tensile strength. However, excessively high contents of Al can lead to a deterioration in the forming characteristics, expressed in a decrease in the r value. In order to minimize the adverse effects of Al, the Al content is therefore restricted to a maximum of 11% by weight. An optimized ratio of reduced density and processibility is established when 8%-11% by weight of Al, especially at least 9% by weight of Al, is present.

The C content in steel of the invention is restricted to at most 0.1% by weight, especially 0.07% by weight, particularly favorable C contents being low contents of less than 0.05% by weight, especially 0.01% by weight or less. C contents above 0.1% by weight can cause the formation of unwanted brittle kappa-carbides ("κ-carbides") at the particle boundaries and cause a resulting decrease in hot and cold formability. In practice, it has been found to be appropriate in this regard to set the C content of the steel of the invention within the range of up to 0.05% by weight, a steel of the invention typically contain up to 0.008% by weight.

The avoidance of the formation of κ-carbides (Fe—Al—C compounds) is of particular significance for the steel of the invention. κ-Carbides form at the particle boundaries at an early stage during the hot processing in the course of processing of generic steels at high temperatures and cause embrittlement of the material. Through the minimization of the C content in accordance with the invention and through the addition of carbide-forming alloying elements in the context of the requirements of the invention, a particularly low free C content is established.

It has been found to be particularly effective with regard to the desired processibility of the steel of the invention for at least one element from the group of the rare earth metals to be added to the steel of the invention in contents of 0.02%-0.2% by weight, especially up to 0.15% by weight, where the rare earth metal content is typically at least 0.03% by weight. In principle, any element from the first transition group of the Periodic Table and the group of the lanthanoids is suitable for this purpose. Particularly useful examples are cerium and lanthanum, which are available comparatively inexpensively and in sufficient volumes. The presence of rare earth metals contributes to an improvement in oxidation stability and strength of a flat steel product of the invention, and has a desulfurizing and deoxidizing effect. The positive effects of rare earth metals in the steel of the invention can be utilized in a particularly target-oriented manner when the contents of rare earth metals are at least 0.03% by weight, and rare earth metal contents in the range of 0.06%-0.12% by weight, especially 0.06%-0.10% by weight, enable particularly operationally reliable production of cold-rolled flat steel products of the invention.

In order to avoid adverse effects from sulfur and phosphorus on the properties of the steel processed in accordance with the invention, the S content is restricted to a maximum of 0.03% by weight, preferably a maximum of 0.01% by weight, and the P content to a maximum of 0.1% by weight, preferably a maximum of 0.05% by weight.

The N content of the flat steel product of the invention is restricted to not more than 0.1% by weight, especially not more than 0.02% by weight, preferably not more than 0.001% by weight, in order to avoid the formation of any great amounts of Al nitrides. These would worsen the mechanical properties.

Ti, Nb, V, Zr, W and Mo may each additionally be added as carbide formers, individually or in different combinations, to the steel of the invention, in order to bind the C content present. The carbides formed in each case through the addition of one or more of the elements Ti, Nb, V, Zr, W, Mo additionally contribute to the increase in strength of the steel of the invention.

For this purpose, Ti and Nb may each be present in the steel of the invention in contents of up to 0.3% by weight, especially up to 0.1% by weight, and V, W and Zr each in contents of up to 1% by weight, especially at 0.5% by weight, and Mo each in contents of up to 1% by weight.

Mo additionally contributes to an increase in tensile strength, creep resistance and fatigue resistance in a flat steel product of the invention. In addition, the carbides formed by Mo with C are particularly fine and thus improve the fineness of the microstructure of the flat steel product of the invention. However, high contents of Mo worsen the hot and cold formability. In order to avoid this in a particularly reliable manner, the Mo content optionally present in a steel of the invention can be restricted to 0.5% by weight.

The addition of Mn in contents of up to 6% by weight, especially up to 3% by weight or up to 1% by weight, can improve the hot formability and weldability of the steel of the invention. Furthermore, Mn promotes deoxidation in the course of melting and contributes to an increase in strength of the steel.

Si in contents of up to 1% by weight, especially up to 0.5% by weight, likewise promotes deoxidation in the course of melting and increases the strength and corrosion resistance of the steel of the invention. In the case of excessively high contents, the presence of Si, however, reduces the ductility of the steel and the suitability thereof for welding.

The addition of Cr in contents of up to 3% by weight can also bind carbon present in the steel of the invention to give carbides. At the same time, the presence of Cr increases corrosion resistance. The advantageous properties of Cr in the steel of the invention are achieved in a particularly purposeful manner when Cr is present in contents of up to 1% by weight.

In order to avoid an increase in the recrystallization temperature, the Co of the steel of the invention is restricted to a maximum of 1% by weight, preferably a maximum of 0.5% by weight.

Nickel in contents of up to 2% by weight, especially 1% by weight, likewise contributes to an increase in strength and toughness in steel of the invention. Furthermore, Ni improves the corrosion resistance and reduces the proportion of primary ferrite in the microstructure of the steel of the invention.

The addition of B can likewise lead to the formation of a fine microstructure which promotes the formability of the steel of the invention. However, excessively high contents of B can impair cold formability and oxidation resistance. Therefore, the B content of the steel of the invention is restricted to 0.05% by weight, especially up to 0.01% by weight.

Cu in contents of up to 3% by weight improves corrosion resistance in the steel of the invention, but can also worsen hot formability and weldability in the case of higher contents. If present, therefore, the Cu content in a practicable configuration of the invention is restricted to at most 1% by weight.

Ca in contents of up to 0.015% by weight, especially 0.005% by weight, binds sulfur, which could reduce the corrosion resistance, in the steel of the invention.

As a result of the production, oxygen is absorbed in steel of the invention, and forms deposits with the rare earth metals present in the strip. If the rare earth metal is Ce, cerium oxide deposits are present in the flat steel product produced in accordance with the invention. If the rare earth metal used is Ce or La, the atomic ratio of the contents of Ce, La and $O_2$ should fulfill the following conditions:

$$0.5 \leq (\%\ Ce + \%\ La)/\%\ O \leq 0.8,$$

preferably $$0.6 \leq (\%\ Ce + \%\ La)/\%\ O \leq 0.7,$$

with % Ce=respective cerium content, % La=respective lanthanum content and % O respective oxygen content of the steel, in each case reported in atom %. These oxides have a diameter of less than 5 μm.

In the production of a cold-rolled flat steel product of the invention, the following steps are performed in accordance with the invention:

melting a steel melt having a composition in accordance with the invention, as per the details given above.

casting the steel melt to give a pre-product, such as a block, a slab, a thin slab or a cast strip. A particularly advantageous method has been found here to be casting to give a cast strip close to the final dimensions. Casting close to the final dimensions can be effected by using conventional casting equipment known per se for this purpose. One example of these is the "twin-roll strip casting machine". Since this method operates with a permanent mold that moves along at the same time, there is no relative movement between the permanent mold and the solidifying strip shell. In this way, these methods can work without casting powder and are therefore of good suitability in principle for producing the preliminary material for production of flat stainless steel products of the invention.

Another positive factor in strip casting is that the cast strip is exposed to low mechanical stresses at most before it is cooled, such that the risk of formation of cracks in the high-temperature range is minimized.

In the course of melting of the steel melt cast in accordance with the invention, a wait time of at least about 15 minutes should pass between the last addition of alloy and the pouring, in order to assure good mixing of the steel melt. Typical pouring temperatures are in the region of about 1590° C.

By practical tests, it was additionally possible to show that steels of the invention can be cast to blocks which can be rolled out to give slabs by blooming.

If required, the pre-product is brought to a preheating temperature of 1000-1300° C. or kept within this temperature range, particularly practicable preheating temperatures having been found here to be 1200-1300° C., especially 1200-1280° C. If the pre-product is a slab, the duration over which the preheating proceeds is, for example, 120-240 minutes.

The pre-product, if appropriate after the optional heating to the preheating temperature, is hot-rolled to give a hot strip, where the rolling end temperature should be more than 820° C., especially more than 850° C., and in practice hot rolling end temperatures of 820-1000° C., especially 850-1000° C., are established. In practical tests, hot rolling end temperatures of above 920° C. have been found to be particularly favorable.

In the non-annealed hot strip, an average ferrite grain length of greater than 100 μm, measured in strip direction, is is to be found in the strip core.

The hot strip obtained is wound to give a coil, where the winding temperature may be up to 850° C., especially 450-750° C.

After winding, the hot strip is annealed. This annealing is of particular significance for the properties of the flat steel product produced in accordance with the invention. The hot strip annealing is conducted at an annealing temperature above 650° C., especially of 700-900° C. Annealing temperatures of about 850° C., especially 850° C.+/−20° C., have been found to be particularly practicable. The annealing times envisaged for the purpose in this annealing, which is typically conducted as a bell annealing, are typically 1-50 h.

As a result of the annealing conducted within the temperature range defined in accordance with the invention, the hot strip, in spite of its high Al contents, can be cold-rolled without occurrence of any significant edge cracks or even strip cracks. The hot strip annealing serves to produce a sufficiently recrystallized recovered strip core region, to lower the cold rolling resistance and to increase the maximum achievable cold rolling level. A texture selection brought about by the hot strip annealing and a high cold forming level promote the formation of a suitable cold strip texture with the desired profile of properties. A particularly suitable method for hot strip annealing is the bell annealing operation with peak temperatures above 650° C. set according to the variants elucidated above.

Hot strip annealing brings about greater recovery of the hot strip and, together with the effects achieved by the presence of rare earth metal in the steel of the invention, brings about very good, reliable cold rollability.

If required, after the annealing, pickling of the hot strip can be conducted, in order to remove residues adhering to the hot strip.

The annealed and optionally pickled hot strip is then cold-rolled to give a cold-rolled flat steel product. The cold rolling can be effected in one stage or in two or more stages, in which case the cold rolling level has to be at least 30%, and is especially at least 40%. Cold rolling levels of more than 40% have been found to be particularly advantageous. Cold rolling levels of at least 30%, preferably more than 40%, are required to introduce a sufficient number of dislocations into the material. This dislocation density is the driving force for the recrystallizing final annealing which is conducted after the cold rolling, and which establishes the desired recrystallized microstructure and texture of the finished flat steel product of the invention.

In the case that the cold rolling is conducted in two or even more cold rolling stages, an intermediate annealing can be conducted between the cold rolling stages.

After the cold rolling, the cold strip obtained is subjected to an annealing which is executed in a continuous annealing operation or in batchwise mode as a bell annealing. Both the final annealing and the intermediate annealings conducted optionally in the course of cold rolling can be conducted in a conventional manner at temperatures and for annealing times which are known per se. In the final annealing of the cold strip, a material having advantageous texture is formed.

The particular annealing of the cold-rolled strip can be effected in continuous conveyor annealing systems with annealing temperatures of 750-850° C. over a typical duration of 1-20 min, and particularly practicable annealing temperatures have been found to be more than 780° C., especially 800-850° C., for an annealing time of 2-5 min. Alternatively, the respective annealing can also be conducted in a bell annealing system in which the annealing temperature is more than 650° C., especially 650-850° C., and the annealing time is 1-50 h. In practice, annealing temperatures of 700-800° C. and an annealing time of 1-30 h have been found to be particularly useful for bell annealing.

Optionally, the cold strip obtained, for example to improve its corrosion resistance, can be covered with a metallic protective layer based, for example on Al or Zn. Suitable methods for this purpose are the coating methods known per se.

To test the invention, four melts of the invention I1, I2, I3 and I4 and three comparative melts C1, C2 and C3 had been melted, and the compositions thereof are reported in table 1.

The steel melts I1-I3 have been cast to give pre-product in the form of blocks. The blocks have then been heated to a preheating temperature PT over a preheating period PP and then formed to slabs.

Subsequently, the heated slabs have been hot-rolled at a hot rolling end temperature HET to give a hot strip and each hot strip obtained has been wound at a winding temperature WT to give a coil.

By means of a twin-roll strip casting system, a cast strip has been produced as pre-product from the steel melt I4, and then likewise hot-rolled to give a hot strip with a hot rolling end temperature HET. The processing to give a hot strip was effected in a continuous, uninterrupted process sequence which follows on from the strip casting, and so the pre-product obtained on entry into the hot rolling unit already had a temperature within the range of the preheating temperatures defined in accordance with the invention and the preheating was unnecessary. The hot strip produced from the steel I4 has also been wound to give a coil at a winding temperature WT after the hot rolling.

After the winding, the hot strips produced in each case, unless stated otherwise in table 2, have been subjected to annealing in a bell annealing system at an annealing temperature AT for an annealing period AP.

The hot strips thus annealed have each been cold-rolled to give a cold-rolled steel strip with a cold rolling level CRL.

The cold-rolled steel strips obtained have then each been subjected to a final annealing at a final annealing temperature FAT for a final annealing period FAP. The final annealing has been executed either as a continuous annealing or as a bell annealing.

The particular preheating period PP, preheating temperature PT, hot rolling end temperature HET, winding temperature WT, annealing temperature AT, annealing period AP, the particular cold rolling level CRL, the particular final annealing temperature FAT, the particular final annealing period FAP and the system used for each final annealing ("bell"=bell annealing system, "continuous"=through-annealing system executed in a continuous run) are reported in table 2.

The mechanical properties "yield point Rp", "tensile strength Rm", "elongation A50", "r value determined in rolling direction r" and "n value determined in rolling direction n" are reported in table 3.

It is found that the cold-rolled steel strips produced in the inventive manner from the steels I1-I4 of the composition of the invention, which have yield points of regularly greater than 400 MPa, especially greater than 420 MPa, and at the same time reach values of 500 MPa or more, and tensile strengths of regularly greater than 500 MPa, especially greater than 520 MPa, and at the same time reach values of 600 MPa or more, and elongation values A50 of at least 16%, always have r values of 1 or greater.

The cold-rolled steel strips produced in the inventive manner from the steels of the invention contain, as well as an Fe(Al) solid solution matrix, a hardening initial order state. In the case of standard hot rolling parameters, rolling is effected in the fully ferritic phase region, and hot strip is obtained with a typical three-layer microstructure which is again characterized by recrystallized globulitic edge regions and the merely recovered core region with columnar crystals. As a result of the Ce content and the inventive manner of processing, however, a texture which is favorable for deep drawing is achieved, which ensures r values of more than 1. This effect does not occur in the case of rare earth metals below 200 ppm, and can be utilized in a particularly reliable manner at rare earth metal contents of at least 300 ppm upward. The hot strip annealing conducted in accordance with the invention reduces the dislocation density in the recovered region and facilitates subsequent processing by cold rolling. Thus, the hot strips having a composition in accordance with the invention cannot only be hot-rolled in the fully ferritic phase region, but unlike the non-inventive rare earth metal-free steels C1-C3 can also be reliably cold-rolled, in spite of the existence of the intermetallic Fe3Al phase at room temperature. By means of suitable final annealing parameters, an extremely firm and reduced-density steel is producible, having high r values and correspondingly optimized forming properties.

Cold-rolled steel strips having a composition not in accordance with the invention do not achieve such r values even when these steel strips have been produced employing production parameters closely matched to the parameters which have been established in the production of the cold-rolled flat steel products of the invention. The steel strips produced in accordance with the invention accordingly have, in spite of their high Al contents, superior suitability for deep drawing, without any requirement for complex alloying or process technology measures for the purpose. The steels C1, C2 and C3 having a composition not in accordance with the invention also contain, as well as an Fe(Al) solid solution matrix, a hardening initial order state. Hot strip annealing does facilitate processing by cold rolling. However, the cold-rolled steel strips having a composition not in accordance with the invention do not attain the r values required for good deep drawing characteristics. Pre-products produced from the steel S3 not in accordance with the invention can be hot-rolled in the fully ferritic phase region, but cannot be cold-rolled without cracking at room temperature because of the existence of the intermetallic Fe3Al phase at room temperature.

TABLE 1

| Steel | C | Si | Mn | P | S | Cr | Mo | Ni | Al | Ce | La | Ce + La | N | Ti | Nb | V |
|---|---|---|---|---|---|---|---|---|---|---|---|---|---|---|---|---|
| I1 | 0.008 | 0.09 | 0.15 | 0.003 | 0.005 | 0.01 | 0.00 | 0.01 | 8.20 | 0.073 | 0.040 | 0.1130 | 0.0032 | 0.001 | 0.003 | 0.002 |
| I2 | 0.007 | 0.09 | 0.25 | 0.003 | 0.005 | 0.40 | 0.01 | 0.02 | 8.30 | 0.048 | 0.019 | 0.0670 | 0.0510 | 0.003 | 0.002 | 0.002 |
| I3 | 0.004 | 0.09 | 0.15 | 0.003 | 0.004 | 0.01 | 0.00 | 0.01 | 10.10 | 0.067 | 0.034 | 0.1010 | 0.0048 | 0.001 | 0.001 | 0.003 |
| I4 | 0.026 | 0.43 | 0.38 | 0.011 | <0.001 | 1.16 | 0.06 | 0.35 | 6.7 | 0.0258 | 0.0152 | 0.0410 | 0.0009 | 0.22 | 0.12 | 0.009 |
| C1 | 0.004 | 0.14 | 0.09 | 0.007 | 0.003 | 0.04 | 0.00 | 0.03 | 8.10 | 0.0004 | 0.0002 | 0.0006 | 0.0048 | 0.004 | 0.004 | 0.016 |
| C2 | 0.005 | 0.11 | 0.11 | 0.004 | 0.003 | 0.03 | 0.01 | 0.03 | 8.20 | 0.0009 | 0.0005 | 0.0014 | 0.0018 | 0.001 | 0.001 | 0.005 |
| C3 | 0.006 | 0.15 | 0.11 | 0.018 | 0.002 | 0.03 | 0.00 | 0.11 | 9.70 | 0.0010 | 0.0006 | 0.0015 | 0.0031 | 0.003 | 0.004 | 0.010 |

Figures in % by weight, balance: iron and unavoidable impurities

TABLE 2

| Steel | PT [° C.] | PP [h] | HET [° C.] | WT [° C.] | AT [° C.] | AP [h] | CRL [%] | FAT [° C.] | FAP | System |
|---|---|---|---|---|---|---|---|---|---|---|
| I1 | 1300 | 2 | 985 | 650 | 740 | 2 | 66 | 720 | 24 h | bell |
| I2 | 1300 | 2 | 960 | 800 | 740 | 2 | 66 | 820 | 3 min | continuous |
| I3 | 1300 | 2 | 1000 | 600 | 740 | 2 | 66 | 720 | 24 h | bell |
| I3 | 1300 | 2 | 1000 | 600 | 740 | 2 | 66 | 820 | 3 min | continuous |
| I4 | — | — | 910 | 600 | 850 | 30 | 50 | 720 | 24 h | bell |
| C1 | 1300 | 2 | 930 | 800 | 740 | 2 | 66 | 720 | 24 h | bell |
| C1 | 1300 | 2 | 930 | 800 | 740 | 2 | 66 | 820 | 3 min | continuous |
| C2 | 1300 | 2 | 960 | 800 | no annealing | | | not cold-rollable | | |
| C2 | 1300 | 2 | 960 | 800 | 740 | 2 | 66 | 820 | 3 min | continuous |
| C2 | 1300 | 2 | 960 | 800 | 850 | 2 | 66 | 820 | 3 min | continuous |
| C2 | 1300 | 2 | 960 | 800 | 740 | 2 | 80 | 820 | 3 min | continuous |
| C3 | 1300 | 2 | 980 | 800 | 740 | 2 | | not cold-rollable | | |

TABLE 3

| Steel | Rp [MPa] | Rm [MPa] | A50 [%] | r *) | n *) |
|---|---|---|---|---|---|
| I1 | 422 | 527 | 22 | 1.21 | 0.14 |
| I2 | 438 | 541 | 23 | 1.02 | 0.14 |
| I3 | 529 | 627 | 18 | 1.05 | 0.12 |
| I3 | 520 | 609 | 19 | 1.25 | 0.12 |
| I4 | 553 | 634 | 16 | 1.13 | 0.12 |
| C1 | 469 | 563 | 24 | 0.71 | 0.15 |
| C1 | 466 | 562 | 22 | 0.72 | 0.15 |
| C2 | | | — | | |
| C2 | 433 | 538 | 25 | 0.80 | 0.14 |
| C2 | 428 | 533 | 21 | 0.85 | 0.15 |
| C2 | 410 | 520 | 16 | 0.83 | 0.14 |
| C3 | | | — | | |

*) in rolling direction

The invention claimed is:

1. A cold-rolled flat steel product for deep drawing applications, consisting of a steel containing, in addition to iron and unavoidable impurities (in % by weight):

C: up to 0.1%,

Al: 6.5-11%,

P: up to 0.1%,

S: up to 0.03%,

N: up to 0.1%, at least one rare earth metal selected from the group consisting of Ce and La, provided that the content of rare earth metals thereof is 0.02%-0.2% by weight, wherein for the contents of cerium and lanthanum with respect to the content of oxygen, which is as a result of the production absorbed in the steel product fulfills the condition:

$$0.5 \leq (\%\ Ce + \%\ La)/\%\ O \leq 0.8,$$

where % Ce=respective cerium content, % La=respective lanthanum content, and % O=respective oxygen content of the steel, in each case reported in atom %, wherein the cold-rolled flat steel product has an r value of at least 1, and wherein the microstructure of the cold-rolled flat steel product contains 0% to 0.1% by volume of κ-carbides.

2. The flat steel product as claimed in claim 1, wherein the Al content thereof is more than 6.7% by weight.

3. The flat steel product as claimed in claim 2, wherein the Al content thereof is 8%-11% by weight.

4. The flat steel product as claimed in claim 1, wherein the C content thereof is not more than 0.05% by weight.

5. The flat steel product as claimed in claim 1, wherein the content of rare earth metals thereof is 0.06%-0.12% by weight.

6. The flat steel product as claimed in claim 1, further containing one or more elements from the group of "Mn, Si, Nb, Ti, Mo, Cr, Zr, V, W, Co, Ni, B, Cu, Ca, N", provided that Mn: up to 6%, Si: up to 1%, Nb: up to 0.3%, Ti: up to 0.3%, Zr: up to 1%, V: up to 1%, W: up to 1%, Mo: up to 1%, Cr: up to 3%, Co: up to 1%, Ni: up to 2%, B: up to 0.1%, Cu: up to 3%, and Ca: up to 0.015%.

* * * * *